US011709009B2

(12) United States Patent
Song et al.

(10) Patent No.: US 11,709,009 B2
(45) Date of Patent: Jul. 25, 2023

(54) ICE BUCKET AGITATOR AND REFRIGERATOR APPLIANCE

(71) Applicants: Haier US Appliance Solutions, Inc., Wilmington, DE (US); Qianmao Zhou, Shanghai (CN)

(72) Inventors: Yayu Song, Shanghai (CN); Qianmao Zhou, Shanghai (CN); Bo Yan, Shanghai (CN); Lixin Zhou, Shanghai (CN); Jun Teng, Shanghai (CN); Xiaoyang Jiang, Shanghai (CN); Jin Wu, Shanghai (CN); Robert Charles Pfaffinger, Jr., Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/936,614

(22) PCT Filed: May 7, 2020

(86) PCT No.: PCT/CN2020/088954
§ 371 (c)(1),
(2) Date: Jul. 23, 2020

(87) PCT Pub. No.: WO2021/223149
PCT Pub. Date: Nov. 11, 2021

(65) Prior Publication Data

US 2023/0129406 A1 Apr. 27, 2023

(51) Int. Cl.
*F25C 5/182* (2018.01)
*F25C 5/20* (2018.01)

(52) U.S. Cl.
CPC ..... *F25C 5/182* (2013.01); *F25C 5/22* (2018.01); *F25C 2300/00* (2013.01)

(58) Field of Classification Search
CPC .... F25C 5/182; F25C 5/22; F25C 5/24; F25C 2300/00; F25C 5/20
See application file for complete search history.

(56) References Cited

U.S. PATENT DOCUMENTS

| | | | | |
|---|---|---|---|---|
| 4,632,280 | A | 12/1986 | Fryover | |
| 9,003,822 | B2 | 4/2015 | Lawson | |
| 2006/0248911 | A1* | 11/2006 | An | F25C 5/20 414/311 |
| 2013/0092707 | A1 | 4/2013 | An | |
| 2015/0176882 | A1* | 6/2015 | Jeong | F25D 23/028 62/344 |

FOREIGN PATENT DOCUMENTS

KR 20060112575 A 11/2006

* cited by examiner

*Primary Examiner* — Elizabeth J Martin
(74) *Attorney, Agent, or Firm* — Dority & Manning, P.A.

(57) ABSTRACT

An ice bucket for a refrigerator appliance, includes a bucket body; an auger provided inside the bucket and including an auger shaft rotatable about a first shaft axis and a collet at a first end of the auger shaft and including an axially beveled surface formed circumferentially around the auger shaft; and an agitator provided in the bucket in mechanical communication with the auger, the agitator including an agitator shaft rotatable about a second shaft axis non-parallel to the first shaft axis, a plurality of first tines extending radially from the agitator shaft within the bucket body to engage ice therein, and a projection that extends perpendicularly from the agitator shaft opposite the plurality of tines. The projection engages with the axially beveled surface to oscillate the agitator.

18 Claims, 9 Drawing Sheets

ICE BUCKET AGITATOR AND REFRIGERATOR APPLIANCE

CROSS REFERENCE TO RELATED APPLICATIONS

The present application is the National Stage Entry of and claims the benefit of priority under 35 U.S.C. § 371 to PCT Application Serial No. PCT/CN2020/088954 filed May 7, 2020 and entitled ICE BUCKET AGITATOR AND REFRIGERATOR APPLIANCE, which is hereby incorporated by reference in its entirety.

FIELD OF THE INVENTION

The present subject matter relates generally to ice making assemblies, and more particularly to an ice making assembly for a refrigerator appliance.

BACKGROUND OF THE INVENTION

Certain refrigerator appliances include an ice maker for producing ice. The ice maker can receive liquid water, and such liquid water can freeze within the ice maker to form ice. In particular, certain ice makers include a mold body that defines a plurality of cavities. The plurality of cavities can be filled with liquid water, and such liquid water can freeze within the plurality of cavities to form ice cubes. These ice cubes can then be stored in an ice bucket in order to be dispensed to a user upon demand.

Many refrigerator appliances mount ice making assemblies within a cabinet or rotating door. For instance, in a "bottom freezer" type refrigerator where the freezer chamber is arranged below or beneath a top mounted fresh food chamber, an automatic ice maker is often disposed in a thermally insulated ice compartment mounted or formed on a door for the top mounted fresh food chamber. During use, ice is delivered through an opening on the door for the fresh food chamber. As another example, a "side by side" type refrigerator, where the freezer chamber is arranged next to the fresh food chamber, an automatic ice maker is often disposed on the door for either one of the freezer chamber or the fresh food chamber. During use, ice is delivered through an opening formed on the door of the respective compartment.

Generally, ice is produced at a constant rate until a sensor provided in the refrigerator senses that the ice bucket is full of ice cubes. According to a refrigerating cycle of refrigerators, a temperature of either of the freezer chamber or the fresh food chamber may rise slightly above freezing, in which case the ice cubes stored in the ice bucket may sweat. When the refrigerating cycle is reinitiated, the sweat between the individual ice cubes may refreeze, leading to a clumping of the ice cubes stored in the ice bucket. For instance, when several iterations of the refrigerating cycle are performed between the times that a user dispenses ice cubes from the ice bucket, the ice cubes may sweat and refreeze into a large clump, thereby restricting an ability to properly dispense the ice cubes.

Accordingly, it would be advantageous to provide an automatic ice maker that addresses one or more of these challenges. In particular, it would be useful to provide features or methods for routinely agitating or stirring the ice cubes within the ice bucket to prevent clumping.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice bucket is provided. The ice bucket may include an auger having an auger shaft and an agitator having an agitator shaft, each disposed inside an ice bucket body. The auger may rotate about a first shaft axis, and the agitator may rotate about a second shaft axis non-parallel to the first shaft axis. The auger may include an axially beveled surface formed circumferentially around the auger shaft. The agitator may include a projection extending radially from an agitator shaft and engaged with the axially beveled surface. The agitator may further include a plurality of tines extending radially from the agitator shaft, opposite the projection.

In another exemplary aspect of the present disclosure, a refrigerator appliance is provided. The refrigerator appliance may include a cabinet, a door, and an ice maker. The cabinet may define a chilled chamber. The door may be mounted to the cabinet. The ice maker may be mounted to the door. The ice maker may include an ice bucket in which ice cubes made by the ice maker are stored. The ice bucket may include an auger having an auger shaft and an agitator having an agitator shaft, each disposed inside an ice bucket body. The auger may rotate about a first shaft axis, and the agitator may rotate about a second shaft axis non-parallel to the first shaft axis. The auger may include an axially beveled surface formed circumferentially around the auger shaft. The agitator may include a projection extending radially from an agitator shaft and engaged with the axially beveled surface. The agitator may further include a plurality of tines extending radially from the agitator shaft, opposite the projection.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
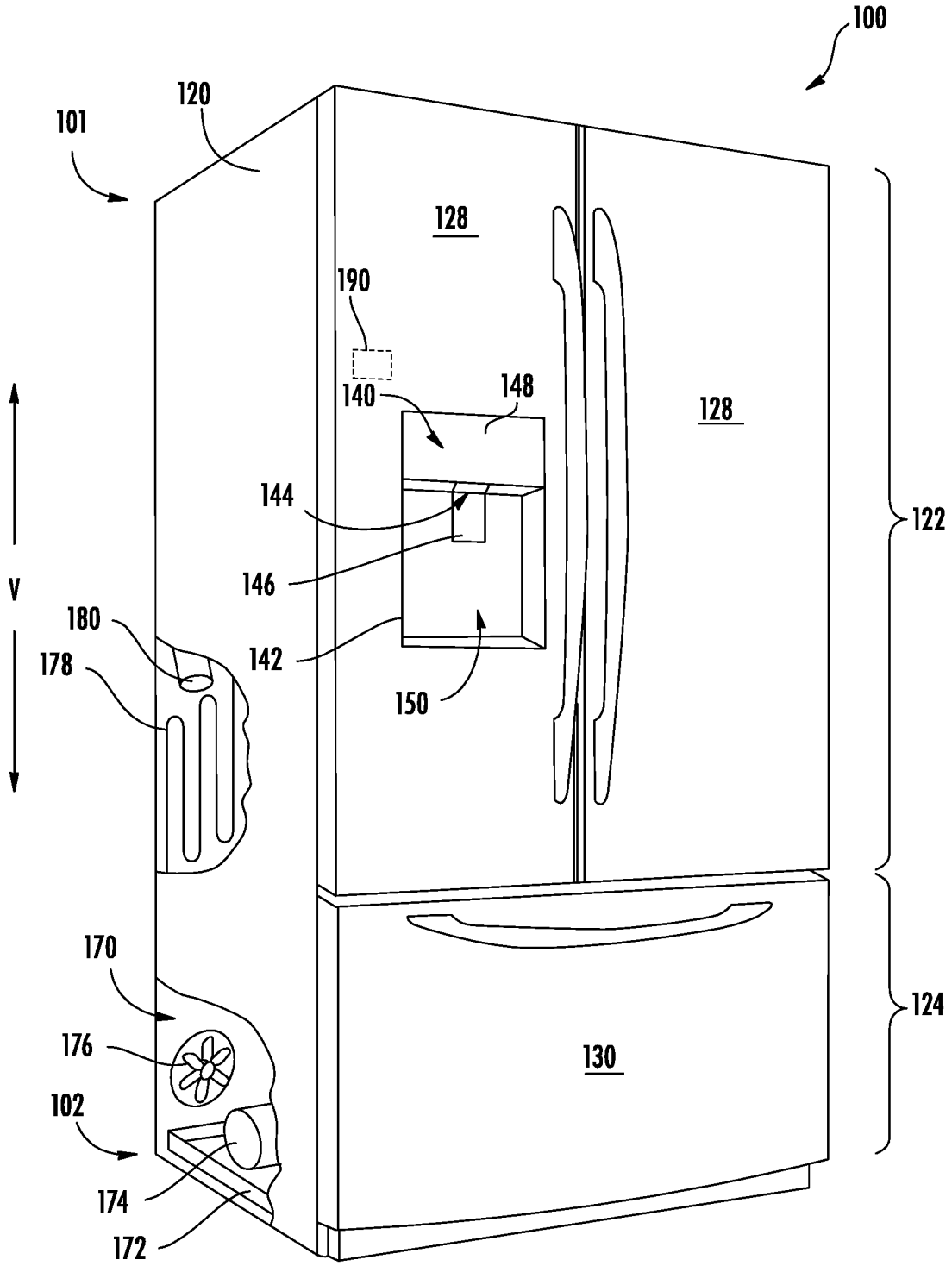
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The term "or" is generally intended to be inclusive (i.e., "A or B" is intended to mean "A or B or both," except as otherwise indicated). Furthermore, as used herein, terms of approximation, such as "approximately," "substantially," or "about," refer to being within a ten percent margin of error.

Turning now to the figures, FIG. 1 provides a perspective view of a refrigerator appliance 100 according to exemplary embodiments of the present disclosure. Refrigerator appliance 100 includes a cabinet or housing 120 that extends between a top portion 101 and a bottom portion 102 along a vertical direction V. Housing 120 defines one or more chilled chambers for receipt of food items for storage. In particular, housing 120 defines fresh food chamber 122 positioned at or adjacent top portion 101 of housing 120 and a freezer chamber 124 arranged at or adjacent bottom portion 102 of housing 120. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular chilled chamber configuration.

In some embodiments, refrigerator doors 128 are rotatably hinged to an edge of housing 120 for selectively accessing fresh food chamber 122. A freezer door 130 is arranged below refrigerator doors 128 for selectively accessing freezer chamber 124. Freezer door 130 may be coupled to a freezer drawer (not shown) slidably mounted within freezer chamber 124. Refrigerator doors 128 and freezer door 130 are shown in a closed configuration in FIG. 1.

Refrigerator appliance 100 also includes a dispensing assembly 140 for dispensing liquid water or ice. Dispensing assembly 140 includes a dispenser 142 positioned on or mounted to an exterior portion of refrigerator appliance 100 (e.g., on one of doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (e.g., an ultrasonic sensor) or a button rather than the paddle. In some embodiments, a user interface panel 148 is provided for controlling the mode of operation. For example, user interface panel 148 may include a plurality of user inputs (not labeled), such as a water dispensing button and an ice dispensing button, for selecting a desired mode of operation such as crushed or non-crushed ice.

In the illustrated embodiments, discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Operation of the refrigerator appliance 100 can be regulated by a controller 190 that is operatively coupled to user interface panel 148 or various other components. User interface panel 148 provides selections for user manipulation of the operation of refrigerator appliance 100 such as, for example, selections between whole or crushed ice, chilled water, or other various options. In response to user manipulation of user interface panel 148 or one or more sensor signals, controller 190 may operate various components of the refrigerator appliance 100. Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry; such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiments, controller 190 is located within the user interface panel 148. In other embodiments, the controller 190 may be positioned at any suitable location within refrigerator appliance 100, such as, for example, within a fresh food chamber 122, a freezer door 130, refrigerator cabinet or housing 120, etc. Input/output ("I/O") signals may be routed between controller 190 and various operational components of refrigerator appliance 100. For example, user interface panel 148 may be in communication with controller 190 via one or more signal lines or shared communication busses.

As illustrated, controller 190 may be in communication with the various components of dispensing assembly 140 and may control operation of the various components. For example, the various valves, switches, etc. may be actuatable based on commands from the controller 190. As discussed, interface panel 148 may additionally be in communication with the controller 190. Thus, the various operations may occur based on user input or automatically through controller 190 instruction.

Figure 2:
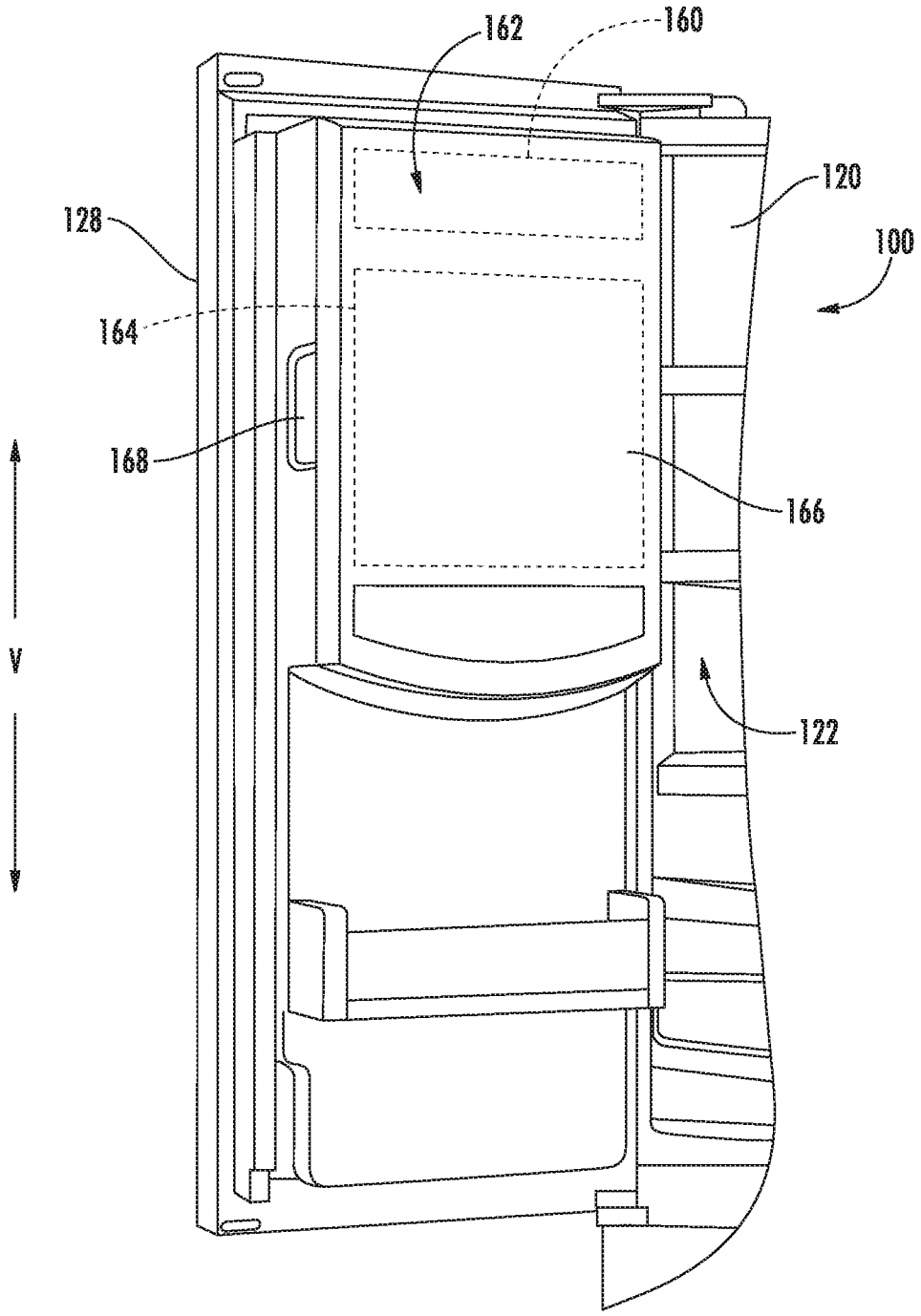
FIG. 2 provides a perspective view of a door of the exemplary refrigerator appliance of FIG. 1.
Figure 3:
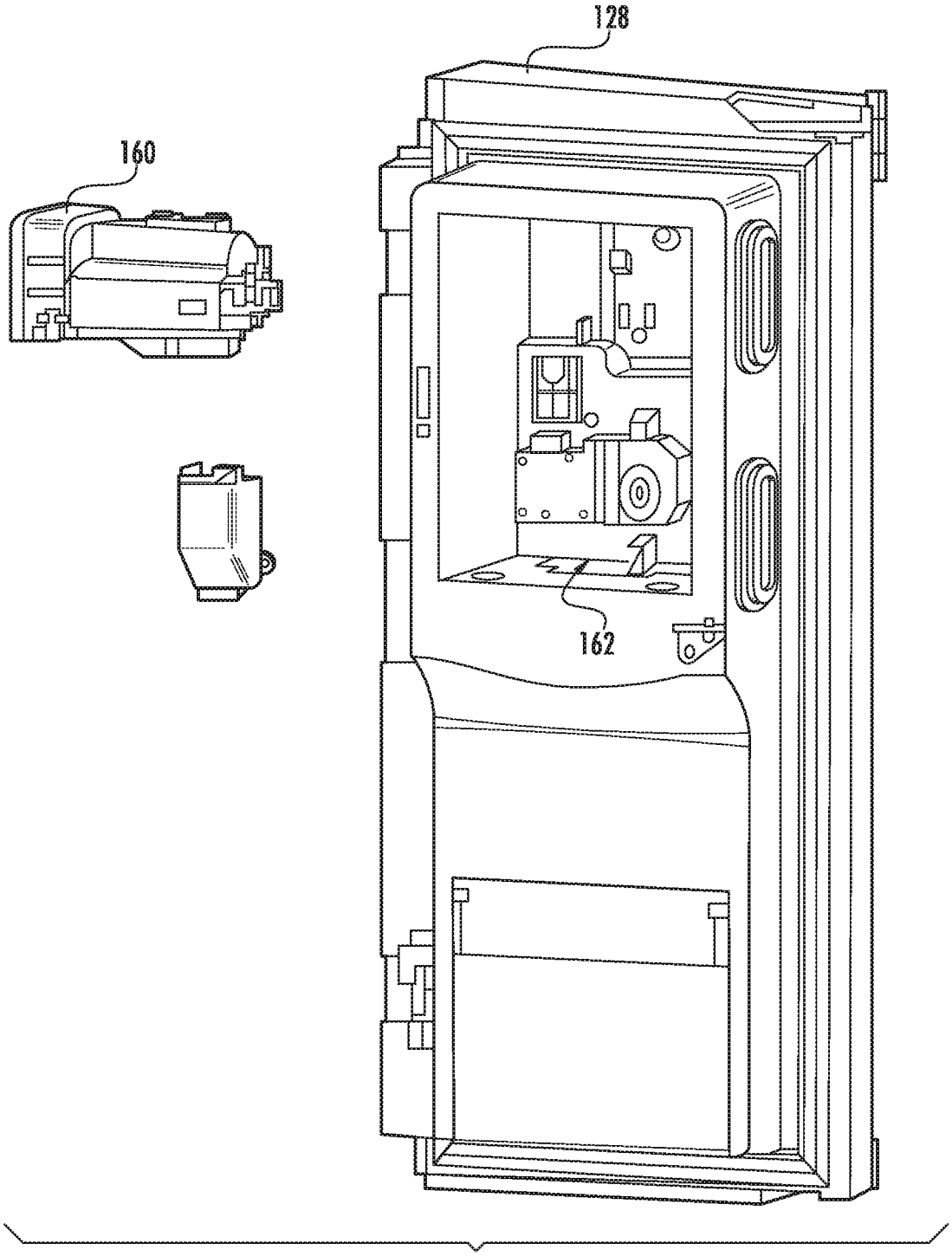
FIG. 3 provides an exploded perspective view of a portion of the exemplary refrigerator door of FIG. 2.

FIG. 2 provides a perspective view of a door of refrigerator doors 128. FIG. 3 provides an exploded view of a portion of refrigerator door 128 with an access door 166 removed. Refrigerator appliance 100 includes a sub-compartment 162 defined on refrigerator door 128. Sub-compartment 162 is often referred to as an "icebox." Moreover, sub-compartment 162 extends into fresh food chamber 122 when refrigerator door 128 is in the closed position.

Generally, an ice supply assembly may be provided to supply ice to dispenser recess 150 (FIG. 1) from ice maker 160 or a separate ice bin 164 in sub-compartment 162 on a back side of refrigerator door 128. In optional embodiments, chilled air from a sealed refrigeration system of refrigerator appliance 100 may be directed into ice maker 160 in order to cool components of ice maker 160. For instance, an evaporator 178 (FIG. 1) may be positioned within a cooling chamber, which may then be located at or in fluid communication with fresh food chamber 122 or freezer chamber 124 and be configured for generating cooled or chilled air. A supply conduit 180 (FIG. 1) may be defined by or positioned within housing 120 and may extend (e.g., in fluid communication) between evaporator 178 and components of ice maker 160 in order to cool components of ice maker 160 and assist ice formation by ice maker 160.

In optional embodiments, liquid water generated during melting of ice cubes in ice storage bin 164, is directed out of the ice storage bin 164. For example, turning back to FIG. 1, liquid water from melted ice cubes may be directed to an evaporation pan 172. Evaporation pan 172 is positioned within a mechanical compartment 170 defined by housing 120 (e.g., at bottom portion 102 of housing 120). For another example, liquid water from melted ice cubes may drain from ice bin 164 to dispenser 142. A condenser 174 of the sealed system can be positioned, for example, directly-above and adjacent evaporation pan 172. Heat from condenser 174 can assist with evaporation of liquid water in evaporation pan 172. A fan 176 configured for cooling condenser 174 can also direct a flow air across or into evaporation pan 172. Thus, fan 176 can be positioned above and adjacent evaporation pan 172. Evaporation pan 172 is sized and shaped for facilitating evaporation of liquid water therein. For example, evaporation pan 172 may be open topped and extend across about a width or a depth of housing 120.

In optional embodiments, an access door 166 is hinged to refrigerator door 128. Access door 166 may generally permit selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162.

Figure 4:
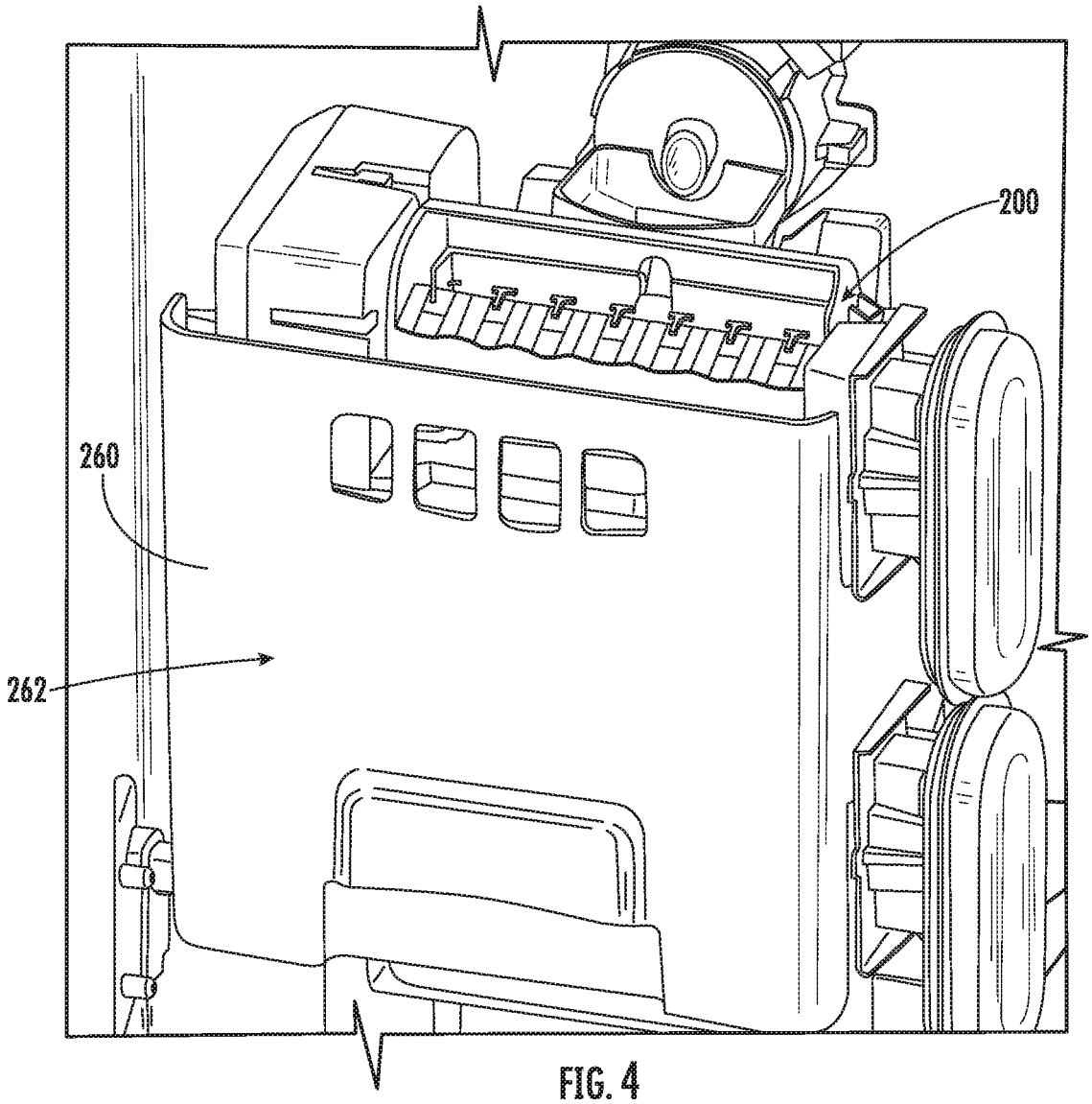
FIG. 4 provides a perspective view of an ice making assembly according to exemplary embodiments of the present disclosure.
Figure 5:
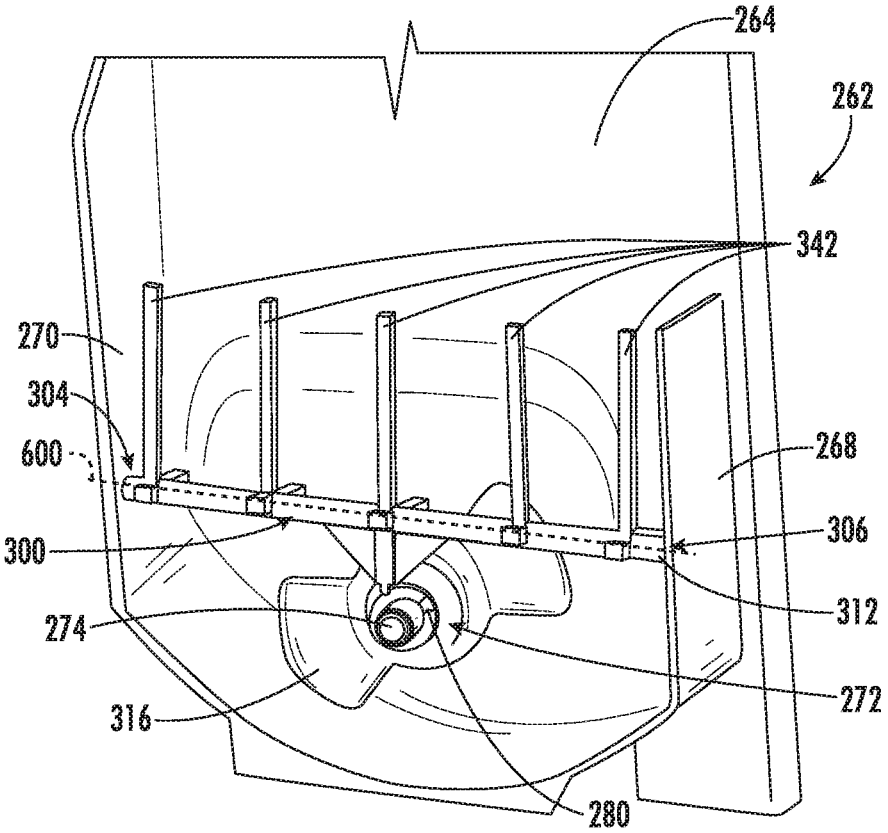
FIG. 5 provides a cut-away perspective view of an inside of an ice bucket attached to the ice making assembly, including an auger and an agitator.
Figure 6:
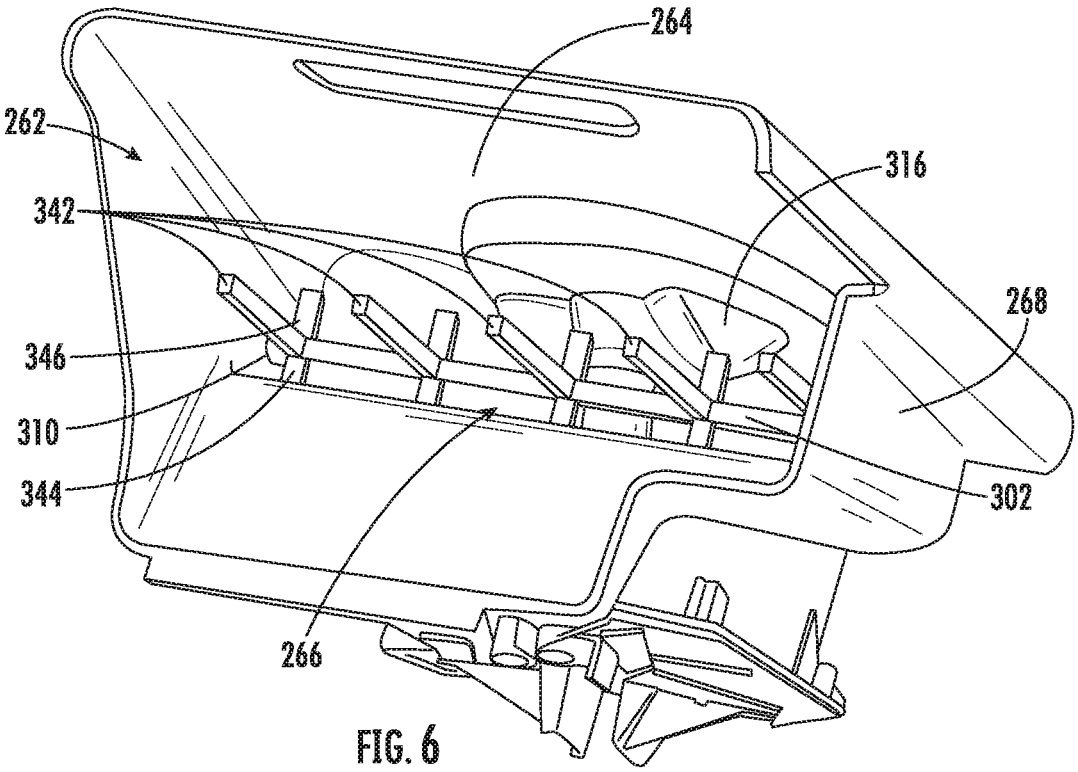
FIG. 6 provides a prospective view of the ice bucket of FIG. 5.
Figure 7:
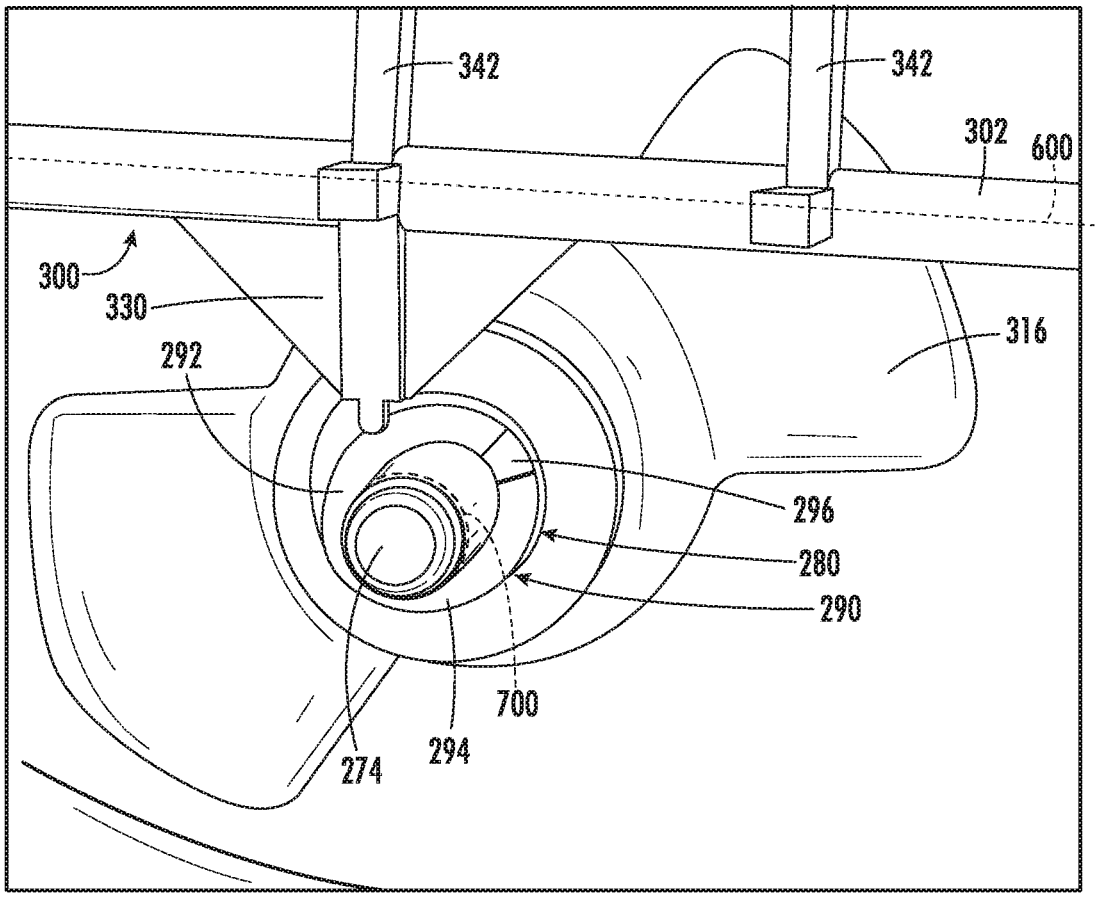
FIG. 7 provides a close-up perspective view of a contact point between an extension of the agitator and an axially beveled surface of the auger.
Figure 8:
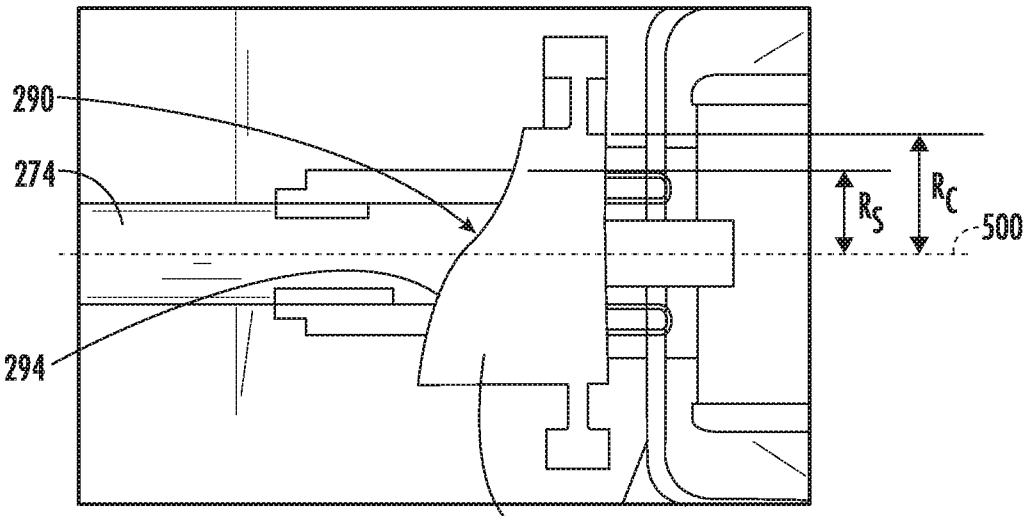
FIG. 8 provides a side view of a portion of an auger shaft within the ice bucket of FIG. 5.
Figure 9:
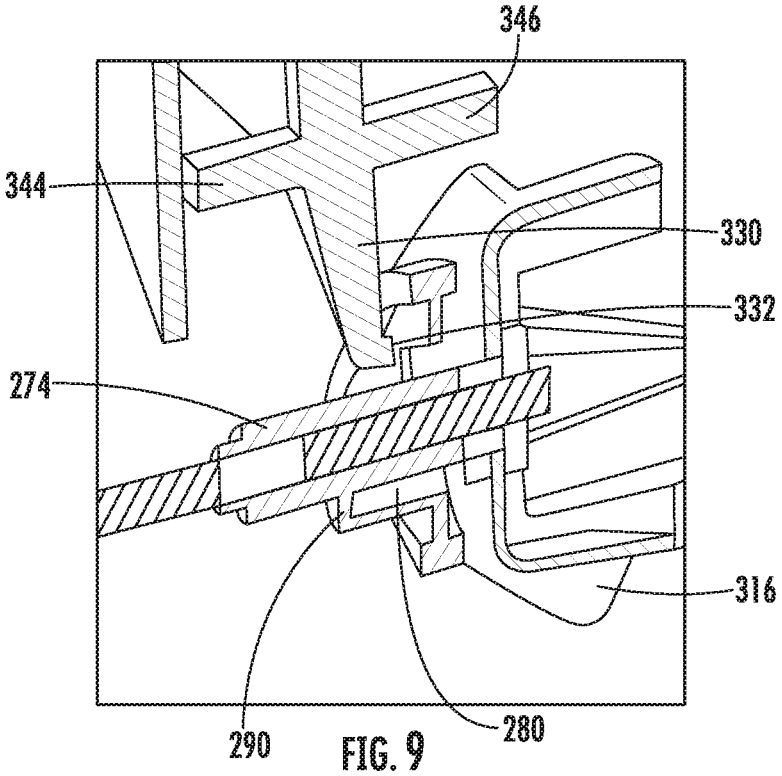
FIG. 9 provides a perspective sectional view of a portion of the auger shaft.
Figure 10:
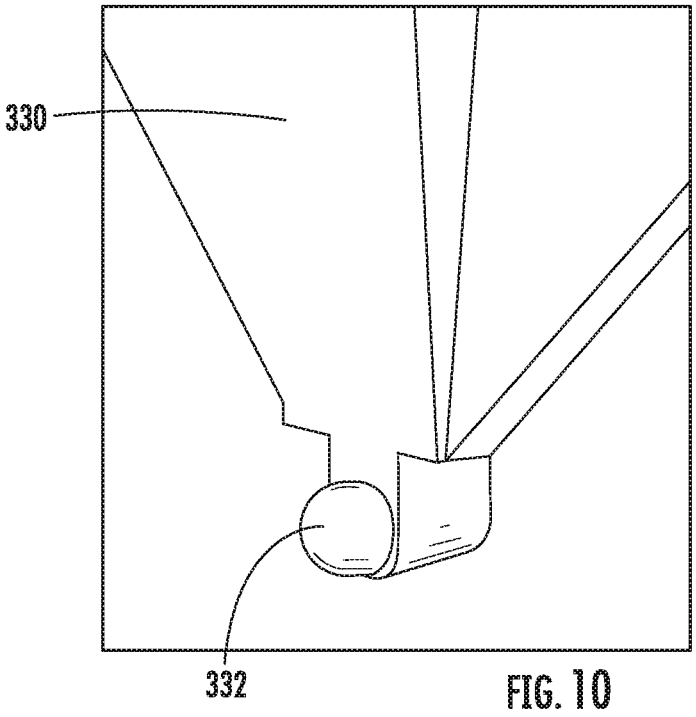
FIG. 10 provides a perspective view of a ballpoint of the extension.

FIG. 4 provides a perspective view of an ice making assembly or ice maker 200, and FIGS. 5 and 6 provide a perspective view of an interior of an ice bucket 260 attached to the ice maker 200. As is understood, ice maker 200 may be used within any suitable refrigerator appliance, such as refrigerator appliance 100 (FIG. 1).

An exemplary ice maker 200 is provided in FIG. 4. Ice maker 200 may be installed in refrigerator door 128 or fresh food chamber 122 and may be cooled by chilled air circulated over evaporator 178, as described previously. An ice bucket 260 may be provided beneath ice maker 200 and may store ice cubes formed in ice maker 200. It is understood that the term "ice cube," as used herein, does not require a cubic geometry (i.e., six bounded square faces), but indicates a discrete unit of solid frozen ice generally having a predetermined three-dimensional shape.

Generally, ice bucket 260 may be provided as, or as part of, ice bin 164 (FIG. 2) and may include a bucket body 262 having a front face 264 that faces an inner side of refrigerator door 128, a rear face 266 opposite the front face 264, and first and second sides 268, 270 connecting the front face 264 and the rear face 266. As would be understood, the bucket body 262 may have any shape to correspond to specific refrigerator applications, and may be manufactured to any dimensions appropriate for holding ice cubes.

Turning now to FIGS. 5 through 9, various views are provided of ice bucket 260. As shown, an auger 272 having an auger shaft 274 may be provided within the bucket body 262. The auger 272 may extend between the rear face 266 and the front face 264 of the bucket body 262, for example, along a first shaft axis 500. The auger shaft 274 may protrude through at least one of the rear face 266 and the front face 264 of the bucket body 262. Generally, the auger shaft 274 may be any suitable shape (e.g., cylindrical).

When assembled, the auger 272 may be mechanically coupled to a motor (e.g., mounted on refrigerator door 128). In turn, the auger shaft 274 may rotate according to an input from a motor. A first end 276 of the auger shaft 274 may be connected to the motor provided outside of the bucket body 262 through one of the rear face 266 and the front face 264. A second end 278 of the auger shaft 274 may be rotatably mounted within the other of the rear face 266 or the front face 264. Optionally, the auger shaft 274 may be orientated lengthwise in the bucket body 262.

During use, the auger shaft 274 may rotate about a first shaft axis 500. The first shaft axis 500 may be orientated in any suitable direction, for example, a horizontal direction. In the illustrated embodiments, the horizontal direction is perpendicular to the vertical direction V and may extend in a lateral direction L or a transversal direction T of the bucket body 262. In certain embodiments, the auger shaft 274 is orientated from about 80° to about 100° from the vertical V direction. Additionally or alternatively, the auger 272 may extend between the first and second sides 268, 270 of the bucket body 262.

In exemplary embodiments, the auger 272 includes a collet 280 on the auger shaft 274. For instance, the auger 272 may include a collet 280 at the first end 276 of the auger shaft 274. The collet 280 may be provided within the bucket body 262, and may be located nearest the front face 264. Alternatively, the collet 280 may be provided nearest the rear face 266. In some embodiments, the collet 280 is provided nearest the first side 268. In still other embodiments, the collet 280 is provided nearest the second side 270. The collet 280 may be a radially enlarged portion of the auger shaft 274. For example, an outer radius $R_c$ of the collet 280 is larger than an outer radius $R_s$ of an adjacent or surrounding portion of the auger shaft 274. As such, the collet 280 may form an axial surface 290 that faces an interior of the bucket body 262. The collet 280 may be a separate piece attached to the auger shaft 274. In alternative embodiments, the collet 280 is integrally formed with the auger shaft 274.

The collet 280 may include an axially beveled surface 290 that encircles the auger shaft 274. The axially beveled surface 290 may be beveled in an axial direction (e.g., parallel to the first shaft axis 500). In other words, at least a portion of the axially beveled surface 290 may protrude axially further than at least another portion of the axially beveled surface 290. The axially beveled surface 290 may be divided into several distinct (e.g., continuous) sections, for example, a first axial surface, a second axial surface, or a third axial surface.

In one example, a first axial surface 292 spirals axially outward (e.g., according to a hyperbolic spiral path) from a base of the collet 280 and extends along a first predetermined percentage of the circumference 700 of the auger shaft 274 (e.g., a percentage of 360° about the first shaft axis 500). The first axial surface 292 may extend between a first end and a second end opposite the first end. The first axial surface 292 may wrap a predetermined percentage of the circumference 700 of the auger shaft 274. In certain embodiments, the first axial surface 292 can wrap from about 40% to about 50% of the circumference 700 of the auger shaft 274. In one example, the first axial surface 292 wraps about 45% of the circumference 700 of the auger shaft 274. The first axial surface 292 may be linear in gradient about the auger shaft 274. In other words, the gradient of change for the first axial surface 292 along the axial direction may be constant. The first axial surface 292 may alternatively be parabolic in gradient about the auger shaft 274. In other words, the gradient of change for the first axial surface 292 along the axial direction may vary.

In additional or alternative examples, a second axial surface 294 spirals axially inward (e.g., according to a hyperbolic spiral path) from the second end of the first axial surface 292 toward the base of the collet 280 and extends along a second predetermined percentage of the circumference 700 of the auger shaft 274 (e.g., a percentage of 360° about the first shaft axis 500). The second axial surface 294 may extend between a first end connected to the second end of the first axial surface 292 and a second end opposite the first end. The second axial surface 294 may wrap a predetermined percentage of the circumference 700 of the auger shaft 274. In certain embodiments, the second axial surface 294 can wrap from about 40% to about 50% of the circumference 700 of the auger shaft 274. In one example, the second axial surface 294 wraps about 45% of the circumference 700 of the auger shaft 274. The second axial surface 294 may be linear in gradient about the auger shaft 274. In other words, the gradient of change for the second axial surface 294 along the axial direction may be constant. The second axial surface 294 may alternatively be parabolic in gradient about the auger shaft 274. In other words, the gradient of change for the second axial surface 294 along the axial direction may vary.

In further additional or alternative examples, a third axial surface 296 may connect two discrete sections. For instance, the third axial surface 296 may connect the first end of the first axial surface 292 and the second end of the second axial surface 294, as shown. The third axial surface 296 may extend between a first end and a second end opposite the first end. The third axial surface 296 may wrap a predetermined percentage of the circumference 700 of the auger shaft 274. In certain embodiments, the third axial surface 296 can wrap from about 0% to about 20% of the circumference 700 of the auger shaft 274. In one example, the third axial surface 296 wraps about 10% of the circumference 700 of the auger shaft 274. Optionally, the third axial surface 296 may be axially flat.

In optional examples, the first axial surface 292 and the second axial surface 294 wrap an equal predetermined percentage of the circumference 700 of the auger shaft 274. For example, each of the first axial surface 292 and the second axial surface 294 may wrap about 45% of the auger shaft 274, and the third axial surface 296 may wrap about 10% about the auger shaft 274.

An agitator 300 may be provided within the bucket body 262 (e.g., in mechanical communication with the collet 280). The agitator 300 may include a rotatable agitator shaft 302. The agitator shaft 302 may extend along a second shaft axis 600. In particular, the agitator shaft 302 may be rotatably mounted to rotate about the second shaft axis 600. When assembled, the second shaft axis 600 may be orientated in any suitable direction, for example, a horizontal direction (e.g., separate and distinct from the horizontal direction of the first shaft axis 500), or any varying degree of horizontal. In the illustrated embodiments, the horizontal direction is perpendicular to the vertical direction V and may extend in a lateral direction L or a transversal direction T of the bucket body 262. The second shaft axis 600 may be non-parallel to the first shaft axis 500. In one example, the second shaft axis 600 is perpendicular to the first shaft axis 500. The agitator shaft 302 may include a first end 304 and a second end 306 opposite the first end 304. Generally, the agitator shaft 302 may be any suitable shape (e.g., cylindrical).

When assembled, the agitator shaft 302 may be supported within the bucket body 262 at the first and second ends 304, 306. For example, the agitator shaft 302 may be orientated widthwise in the bucket body 262. Optionally, each of the first and second sides 268, 270 may have a bearing 310, 312 configured to support the agitator shaft 302. The bearings 310, 312 may be any suitable bearing, for example, a flange bearing, a pillow block bearing, a journal bearing, or a sleeve bearing.

The agitator 300 may further include a spring 320 biasing the agitator shaft 302 in a circumferential direction (e.g., a rotational direction of the agitator shaft 302). In one example, the circumferential direction is a counterclockwise direction with respect to FIG. 11. For example, the spring 320 may be a torsion spring provided on the agitator shaft 302 at one of the bearings 310, 312. However, the spring 320 may be any spring capable of biasing the agitator shaft 302. For instance, the spring 320 may be a compression spring that acts on a radial extension of the agitator shaft 302.

The agitator 300 may also include a projection 330 extending from the agitator shaft 302 to engage (e.g., directly or indirectly) with the collet 280 of the auger shaft 274. As shown, the projection 330 may extend radially from the agitator shaft 302 (e.g., perpendicular to the second shaft axis 600). A distal end of the projection 330 (e.g., distal to the agitator shaft 302) may include a ballpoint 332. The ballpoint 332 may be provided on a first side of the projection 330 and may face the axially beveled surface 290 of the collet 280. A shape and position of the ballpoint 332 is not limited to that which is described herein, and any appropriate shape and position of the ballpoint 332 may be used (e.g., to slide along the axially beveled surface 290).

When assembled, the spring 320 may bias the agitator shaft 302 such that the ballpoint 332 is in continual contact with the axially beveled surface 290 of the collet 280. In one embodiment, the agitator shaft 302 is provided above the auger shaft 274, such that the projection 330 extends substantially downward. Thus, the ballpoint 332 may be provided on a rear face of the projection 330 in order to contact the axially beveled surface 290 of the collet 280. As the auger shaft 274 and the collet 280 rotate, the axially beveled surface 290 may slide along the ballpoint 332. The first axial surface 292 of the axially beveled surface 290 may displace the ballpoint 332 in an axial direction (e.g., move the ballpoint 332 forward or rearward along the same direction as the first shaft axis 500).

For instance, when the ballpoint 332 is located at an initial position (e.g., a 0° vertical position with respect to the auger shaft 274), subsequent rotation of the auger shaft 274 may slide the first axial surface 292 of the axially beveled surface 290 against the ballpoint 332 from the first end to the second end. As the ballpoint 332 slides from the first end to the second end, the ballpoint 332 may be displaced axially (e.g., forward) from the initial position. In one example, the ballpoint 332 is displaced toward a center of the bucket body 262.

In another instance, when the ballpoint 332 is located at an initial position (e.g., a 0° vertical position with respect to the auger shaft 274), subsequent rotation of the auger shaft 274 may slide the second axial surface 294 of the axially beveled surface 290 against the ballpoint 332 from the first end to the second end. As the ballpoint 332 slides from the first end to the second end, the ballpoint 332 may be displaced axially (e.g., rearward) from the initial position. In one example, the ballpoint 332 is displaced away from a center of the bucket body 262 (e.g., due to a biasing of the spring 320).

In still another instance, when the ballpoint 332 is located at an initial position (e.g., a 0° vertical position with respect to the auger shaft 274), subsequent rotation of the auger shaft 274 may slide the third axial surface 296 of the axially beveled surface 290 against the ballpoint 332 from the first end to the second end. As the ballpoint 332 slides from the first end to the second end, the ballpoint 332 may remain axially static in the initial position (e.g., in a predetermined resting position).

In some embodiments, the agitator 300 may include a plurality of tines 340 (e.g., extending from the agitator shaft 302). The plurality of tines 340 may include a plurality of first tines 342 that extend radially from the agitator shaft 302 (e.g., opposite the projection 330). When assembled, the plurality of first tines 342 may be fixed to the agitator shaft 302. For instance, the plurality of first tines 342 may be separate pieces attached to the agitator shaft 302, or, alternatively, the plurality of first tines 342 may be integrally formed with the agitator shaft 302. The plurality of first tines 342 may be spaced apart from each other (e.g., axially) along the agitator shaft 302. The spacing between each of the plurality of first tines 342 may be equal, or, alternatively, varied. In one embodiment, each of the plurality of first tines 342 is spaced apart by about 2 inches. The plurality of first tines 342 may be parallel with each other along the axis of the agitator shaft 302 (e.g., the second shaft axis 600). In an alternative embodiment, the plurality of first tines 342 may be circumferentially staggered along the axis of the agitator shaft 302.

The plurality of first tines 342 may extend substantially upward within the bucket body 262. For example, at the resting position (e.g., when the ballpoint 332 contacts the third axial surface 296), the plurality of first tines 342 extend from the agitator shaft 302 in the vertical direction V. Each of the plurality of first tines 342 may extend to a predetermined length $l_1$ from or relative to the agitator shaft 302. In one example, each of the plurality of first tines 342 extends to an equal length (e.g., 5 inches). Alternatively, two or more of the plurality of first tines 342 may extend to discrete or different lengths. A top of each of the plurality of first tines 342 may be provided below a top of the bucket body 262. Additionally, the length $l_1$ of each of the plurality of first tines 342 may be such that the first tines 342 do not contact the bucket body 262 when the agitator shaft 302 is rotated through a predetermined rotation angle (e.g., relative to the second shaft axis 600 and as determined by the axial range of motion of the projection 330). The agitator shaft 302, the projection 330, and the plurality of tines 340 may be made from any suitable material (e.g. plastic, composite, metal, rubber, etc.)

In additional or alternative embodiments, the plurality of tines 340 includes a plurality of second tines 344 that extend radially from the agitator shaft 302. When assembled, the plurality of second tines 344 may be fixed to the agitator shaft 302. For instance, the plurality of second tines 344 may be separate pieces attached to the agitator shaft 302, or, alternatively, the plurality of second tines 344 may be integrally formed with the agitator shaft 302. The plurality of second tines 344 may be circumferentially spaced apart from the plurality of first tines 342 (e.g., about the second shaft axis 600). In one embodiment, the plurality of second tines 344 is spaced 90° circumferentially about the agitator shaft 302 from the plurality of first tines 342. Nonetheless, it is understood that the circumferential spacing between the plurality of second tines 344 and the plurality of first tines 342 may vary according to specific applications.

The plurality of second tines 344 may be spaced apart from each other (e.g., axially) along the agitator shaft 302. The spacing between each of the plurality of second tines 344 may be equal, or, alternatively, varied. In one embodiment, each of the plurality of second tines 344 is spaced apart by about 2 inches. The plurality of second tines 344 may be parallel with each other along the axis of the agitator shaft 302 (e.g., the second shaft axis 600). In an alternative embodiment, the plurality of second tines 344 may be circumferentially staggered along the axis of the agitator shaft 302. Each of the plurality of second tines 344 may extend to a predetermined length $l_2$. In one example, each of the plurality of second tines 344 extends to an equal length (e.g., 1 inch). Alternatively, the plurality of second tines 344 may extend to lengths different from one another.

In optional embodiments, a plurality of third tines 346 may extend radially from the agitator shaft 302 and may be circumferentially spaced from the plurality of first tines 342 (e.g., opposite the plurality of second tines 344). When assembled, the plurality of third tines 346 may be fixed to the agitator shaft 302. For instance, the plurality of third tines 346 may be separate pieces attached to the agitator shaft 302, or, alternatively, the plurality of third tines 346 may be integrally formed with the agitator shaft 302. The plurality of third tines 346 may be spaced apart from each other (e.g., axially) along the agitator shaft 302. The spacing between each of the plurality of third tines 346 may be equal, or, alternatively, varied. In one embodiment, each of the plurality of third tines 346 is spaced apart by about 2 inches. The plurality of third tines 346 may be parallel with each other along the axis of the agitator shaft 302 (e.g., the second shaft axis 600). In an alternative embodiment, the plurality of third tines 346 may be circumferentially staggered along the second shaft axis 600. Each of the plurality of third tines 346 may extend to a predetermined length $l_3$. In one example, each of the plurality of third tines 346 extends to an equal length (e.g., 1 inch). Alternatively, two or more of the plurality of third tines 346 may extend to lengths different from one another.

In further or additional embodiments, a first agitator paddle 316 is rotatably disposed within the bucket body. For instance, the first agitator paddle 316 may be mounted to the front face (e.g., to rotate about the first shaft axis 500). Optionally, the first agitator paddle 316 may be in communication with the auger shaft (e.g., via a pin or gear connection) to selectively rotate as directed by the auger shaft. During use, the first agitator paddle 316 may thus be selectively rotated to aid movement or agitate (e.g., to prevent sublimation of) ice within the bucket body.

Figure 11:
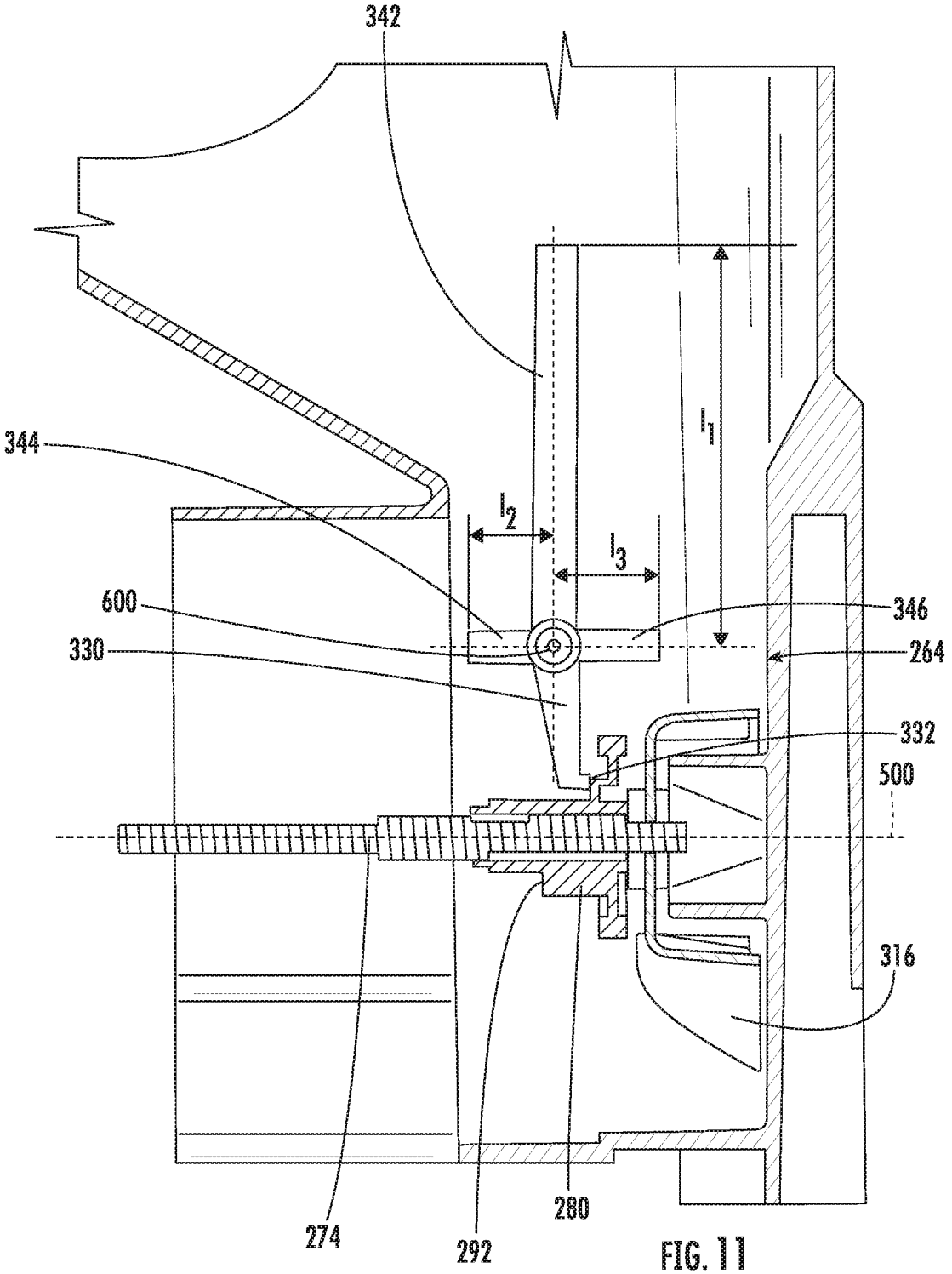
FIG. 11 provides a side sectional view of the auger shaft in a first position.
Figure 12:
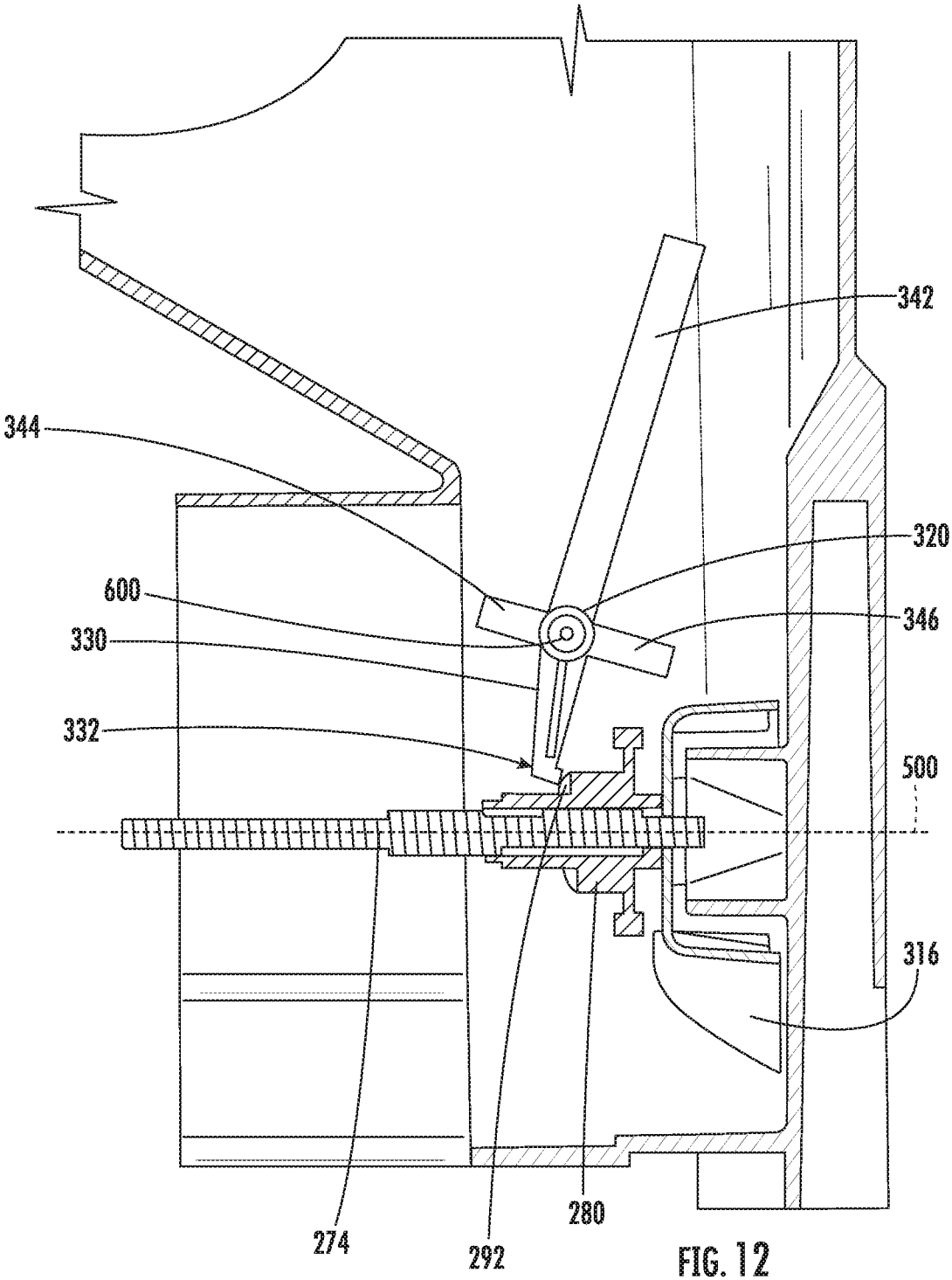
FIG. 12 provides a side sectional view of the auger shaft in a second position.

Turning now generally to FIGS. 11 and 12, an operation of the agitator 300 will be described. When the ballpoint 332 is in contact with the third axial surface 296 of the axially beveled surface 290 (e.g., the resting position), the plurality of first tines 342 may extend upward within the bucket body 262, as seen in FIG. 11. While the ballpoint 332 is in contact with the third axial surface 296 of the axially beveled surface 290, the first tines may remain in the generally vertical position (i.e., no movement or oscillation). As the auger shaft 274 is turned, the ballpoint 332 may be guided along the first axial surface 292 of the axially beveled surface 290 from the first end to the second end, such that the ballpoint 332 is axially displaced, the agitator shaft is rotated, and the plurality of tines 340 (e.g., the plurality of first tines 342, the plurality of second tines 344, or the plurality of third tines 346) oscillate within the bucket body 262. In one example, as the auger shaft 274 is rotated and the ballpoint 332 is guided along the first axial surface 292 of the axially beveled surface 290, the plurality of first tines 342 oscillate toward the rear face 266 of the bucket body 262 (e.g., FIG. 12). When the ballpoint 332 is then guided along the second axial surface 294 of the axially beveled surface 290, the plurality of first tines may oscillate toward the front face 264 of the bucket body 262 and return to an original upright position (e.g., FIG. 11). As the auger shaft 274 is continually rotated, this process may be repeated with each full revolution of the auger shaft 274.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice bucket for a refrigerator appliance, the ice bucket comprising:
- a bucket body;
- an auger provided inside the bucket, the auger comprising
  - an auger shaft rotatable about a first shaft axis; and
  - a collet at a first end of the auger shaft and including an axially beveled surface formed circumferentially around the auger shaft; and
- an agitator provided in the bucket in mechanical communication with the auger, the agitator comprising
  - an agitator shaft rotatable about a second shaft axis non-parallel to the first shaft axis;
  - a plurality of first tines extending radially from the agitator shaft within the bucket body to engage ice therein; and
  - a projection that extends perpendicularly from the agitator shaft opposite the plurality of tines, wherein the projection is configured to engage with the axially beveled surface.

2. The ice bucket of claim 1, wherein the projection comprises a ballpoint slidably disposed on the axially beveled surface, and wherein the axially beveled surface guides the ballpoint during a rotation of the auger shaft.

3. The ice bucket of claim 2, further comprising a spring biasing the ballpoint against the axially beveled surface.

4. The ice bucket of claim 3, wherein the spring is a torsion spring attached to the agitator shaft.

5. The ice bucket of claim 1, wherein the agitator shaft further comprises:
- a plurality of second tines extending radially from the agitator shaft, the plurality of second tines being circumferentially spaced apart from the plurality of first tines.

6. The ice bucket of claim 5, wherein a radial length of each of the plurality of first tines is greater than a radial length of each of the plurality of second tines.

7. The ice bucket of claim 1, further comprising a first bearing provided on a first inner side of the bucket body and a second bearing provided on a second inner side of the bucket body opposite the first inner side, wherein the agitator shaft is rotatably coupled to the first and second bearings.

8. The ice bucket of claim 1, wherein the axially beveled surface comprises:
- a first axial surface perpendicular to the first shaft axis and having a first circumferential end and a second circumferential end;
- a second axial surface that spirals axially outward about the auger shaft and having a third circumferential end and a fourth circumferential end, the third circumferential end being connected to the second circumferential end, and the fourth circumferential end being spaced a predetermined angle about the auger shaft from the third circumferential end; and
- a third axial surface that spirals axially inward about the auger shaft and having a fifth circumferential end and a sixth circumferential end, the fifth circumferential end being connected to the fourth circumferential end, and the sixth circumferential end being connected to the first circumferential end.

9. The ice bucket of claim 8, wherein a circumferential length of the second axial surface is equal to a circumferential length of the third axial surface and longer than a circumferential length of the first axial surface.

10. A refrigerator appliance comprising:
- a fresh food compartment;
- a freezing compartment adjacent to the fresh food compartment;
- an ice maker provided in one of the fresh food compartment or the freezing compartment; and
- an ice bucket configured to store ice made by the ice maker; the ice bucket comprising:
  - a bucket body;
  - an auger provided inside the bucket body, the auger comprising
    - an auger shaft rotatable about a first shaft axis; and
    - a collet at a first end of the auger shaft and including an axially beveled surface formed circumferentially around the auger shaft; and
  - an agitator provided in the bucket in mechanical communication with the auger, the agitator comprising an agitator shaft rotatable about a second shaft axis non-parallel to the first shaft axis;

a plurality of first tines extending radially from the agitator shaft within the bucket body to engage ice therein; and a projection extending radially from the agitator shaft opposite the plurality of tines, wherein the projection is configured to engage with the axially beveled surface.

11. The refrigerator appliance of claim 10, wherein the projection comprises a ballpoint slidably disposed on the axially beveled surface, and wherein the axially beveled surface guides the ballpoint during a rotation of the auger shaft.

12. The refrigerator appliance of claim 11, wherein the ice bucket further comprises a spring biasing the ballpoint against the axially beveled surface.

13. The refrigerator appliance of claim 12, wherein the spring is a torsion spring attached to the agitator shaft.

14. The refrigerator appliance of claim 10, wherein the agitator shaft further comprises:

a plurality of second tines extending radially from the agitator shaft, the plurality of second tines being circumferentially spaced apart from the plurality of first tines.

15. The refrigerator appliance of claim 14, wherein a radial length of each of the plurality of first tines is greater than a radial length of each of the plurality of second tines.

16. The refrigerator appliance of claim 10, further comprising a first bearing provided on a first inner side of the bucket body and a second bearing provided on a second inner side of the bucket body opposite the first inner side, wherein the agitator shaft is rotatably coupled to the first and second bearings.

17. The refrigerator appliance of claim 10, wherein the axially beveled surface comprises:

a first axial surface that is perpendicular to the first shaft axis and having a first circumferential end and a second circumferential end;

a second axial surface that spirals axially outward about the auger shaft and having a third circumferential end and a fourth circumferential end, the third circumferential end being connected to the second circumferential end, and the fourth circumferential end being spaced a predetermined angle about the auger shaft from the third circumferential end; and a third axial surface that spirals axially inward about the auger shaft and having a fifth circumferential end and a sixth circumferential end, the fifth circumferential end being connected to the fourth circumferential end, and the sixth circumferential end being connected to the first circumferential end.

18. The ice bucket of claim 17, wherein a circumferential length of the second axial surface is equal to a circumferential length of the third axial surface and longer than a circumferential length of the first axial surface.

* * * * *